US006022119A

United States Patent [19]

Booty, Jr.

[11] Patent Number: 6,022,119

[45] Date of Patent: Feb. 8, 2000

[54] BOOK LIGHT

[75] Inventor: Donald J. Booty, Jr., Chicago, Ill.

[73] Assignee: Phorm Concept & Design, Inc., Scottsdale, Ariz.

[21] Appl. No.: 08/931,443

[22] Filed: Sep. 16, 1997

[51] Int. Cl.[7] ..... F21V 21/28; F21V 21/29

[52] U.S. Cl. ..... 362/98; 362/419; 362/427; 362/450; 362/421

[58] Field of Search ..... 362/429, 427, 362/419–421, 450, 98, 426

[56] References Cited

U.S. PATENT DOCUMENTS

| | | | |
|---|---|---|---|
| D. 287,412 | 12/1986 | Fung . | |
| D. 374,100 | 9/1996 | Chen | D26/60 |
| 2,561,744 | 7/1951 | Langdon et al. . | |
| 4,432,042 | 2/1984 | Zeller . | |
| 4,581,684 | 4/1986 | Mazzucco . | |
| 4,598,340 | 7/1986 | Dwosh et al. . | |
| 4,700,634 | 10/1987 | Mills | 108/43 |
| 4,847,740 | 7/1989 | Laske | 362/427 |
| 5,182,032 | 1/1993 | Dickie | 249/91 |
| 5,183,324 | 2/1993 | Thomas . | |
| 5,222,806 | 6/1993 | Roberts, III | 362/401 |
| 5,280,416 | 1/1994 | Hartley et al. . | |
| 5,369,556 | 11/1994 | Zeller | 362/198 |
| 5,379,201 | 1/1995 | Friedman . | |
| 5,422,802 | 6/1995 | Lin | 362/269 |
| 5,442,528 | 8/1995 | Vandenbelt . | |
| 5,695,271 | 12/1997 | Zeller | 362/98 |

FOREIGN PATENT DOCUMENTS

| | | | |
|---|---|---|---|
| 1207093 | 2/1960 | France | 362/429 |
| 646733 | 11/1950 | United Kingdom . | |
| 94/12077 | 6/1994 | WIPO . | |

*Primary Examiner*—Sandra O'Shea
*Assistant Examiner*—Marshall Honeyman
*Attorney, Agent, or Firm*—Richard C. Litman

[57] ABSTRACT

A book light having a pair of arms or a "U" bracket pivotally attached to a head at one end and a body at the other end. In the case of the "U" bracket, the head is attached by a ball joint and has infinite ranges of motion. The body has a clip for attachment to a book or a bed frame, an on/off switch, a plug for receiving an AC adapter, and a battery compartment. The head has a light assembly and a fluorescent light bulb for illuminating a book. A wire or conductive strip running along, and guided by wire guides, each of the arms provides an electrical connection between the light assembly and the source of power. The pivoting of the head and the body allow them to be pivoted for storage in the space between the arms or so that the book light be used as a free-standing desk lamp. Optionally, the two arms or the "U" bracket may be connected to a pivot arm which swivels about the body to increase the degrees of freedom and the flexibility of the light.

16 Claims, 9 Drawing Sheets

BOOK LIGHT

BACKGROUND OF THE INVENTION

1. Field of the Invention

The present invention relates to a book light which is free-standing or attaches to a book cover, a bed frame, or other supporting objects to facilitate the reading of a book or generally provide light where needed.

2. Description of the Related Art

Lights for illuminating books, and other lighting accessories are well known in the prior art, but all suffer deficiencies which are cured by the instant invention.

U.S. Pat. No. 4,598,340, issued on Jul. 1, 1986 to Jack Dwosh et al., teaches a portable book light having a light source pivotally attached to a casing member containing a battery compartment which can be attached to a book by a somewhat-perpendicular member which has a clip. However, in contrast to the instant invention, the location of the battery compartment results in a heavier weight being suspended above the book, resulting in the possibility of unintended, annoying moving of the light.

U.S. Pat. Nos. 2,561,744, issued on Jul. 24, 1951 to V. V. Langdon et al., 4.432,042, issued on Feb. 14, 1984 to Noel E. Zeller, 4,581,684, issued on Apr. 8, 1986 to Daniel Mazzucco, Des. 287,412, issued on Dec. 23, 1986 to Mary Fung, and Des. 374,100, issued on Sep. 24, 1996 to Mike Chen, and French Pat. No. 1,207,093, published Feb. 15, 1960, teach book lights and portable lamps in which the lamp is supported by one movable arm, an inherent structural defect.

U.S. Pat. Nos. 5,280,416, issued on Jan. 18, 1994 to John B. Hartley et al., and 5,442,528, issued on Aug. 15, 1995 to Rudy A. Vandenbelt, and World Intellectual Property Organization Publication No. WO 94/12077, published on Jun. 9, 1994, teach bookmark lights which have light sources supported by a single sliding arm. However, in that all of the above inventions have only one arm, they suffer from the problem of light bounce, i.e. instability. Although perhaps this is not a structural problem insofar as the integrity of the structure is concerned, it is a particular annoyance to the user of the invention to have the light source bouncing about at the slightest movement of the book while one is reading. In addition to the stability deficiency of these prior inventions, it is noted that the lack of two arms or a "U" bracket precludes the instant folding of the head and the body.

Other prior inventions, for example those in U.S. Pat. Nos. 5,183,324, issued on Feb. 2, 1993 to Roy Thomas, and 5,379,201, issued on Jan. 3, 1995 to Arthur S. Friedman, teach accessories having a portion for attachment to a belt or a laptop computer and a portion with a light. However, these inventions lack the extension provided by the instant arms or "U" bracket.

An illuminated writing pad is shown in British Patent No. 646,733, published on Nov. 29, 1950. However, a similarity in functionality is the only relationship to the instant invention.

None of the above inventions and patents, taken either singularly or in combination, is seen to describe the instant invention as claimed. Thus a book light solving the aforementioned problems, particuLarly light bounce, is desired.

SUMMARY OF THE INVENTION

The instant invention relates to a book light having a pair of arms or a "U" bracket pivotally attached to a head at one end and a body at the other end. In the case of the "U" bracket, the head is attached by a ball joint and has infinite ranges of motion. The body has a clip fcr attachment to a book or a bed frame, an on/off switch, a plug for receiving an AC adapter, and a battery compartment. The head has a light assembly and a fluorescent light bulb for illuminating a book. A wire or conductive strip running along, and guided by wire guides, each of the arms provides an electrical connection between the light assembly and the source of power. The pivoting of the head and the body allow them to be pivoted for storage in the space between the arms or so that the book light be used as a free-standing desk lamp. Optionally, the two arms or the "U" bracket may be connected to a pivot arm which swivels about the body to increase the degrees of freedom and the flexibility of the light.

Accordingly, it is a principal object of the invention to provide a book light which has a light source supported by two arms for a great deal of stability.

It is another object of the invention to provide a book light that can be pivoted for controlling the illumination as desired.

It is a further object of the invention to provide a book light that is structurally capable of folding into a small space for storage and portability.

Yet another object of the invention to provide a book light that can be used as a free-standing desk lamp.

It is an object of the invention to provide improved elements and arrangements thereof in a book light for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
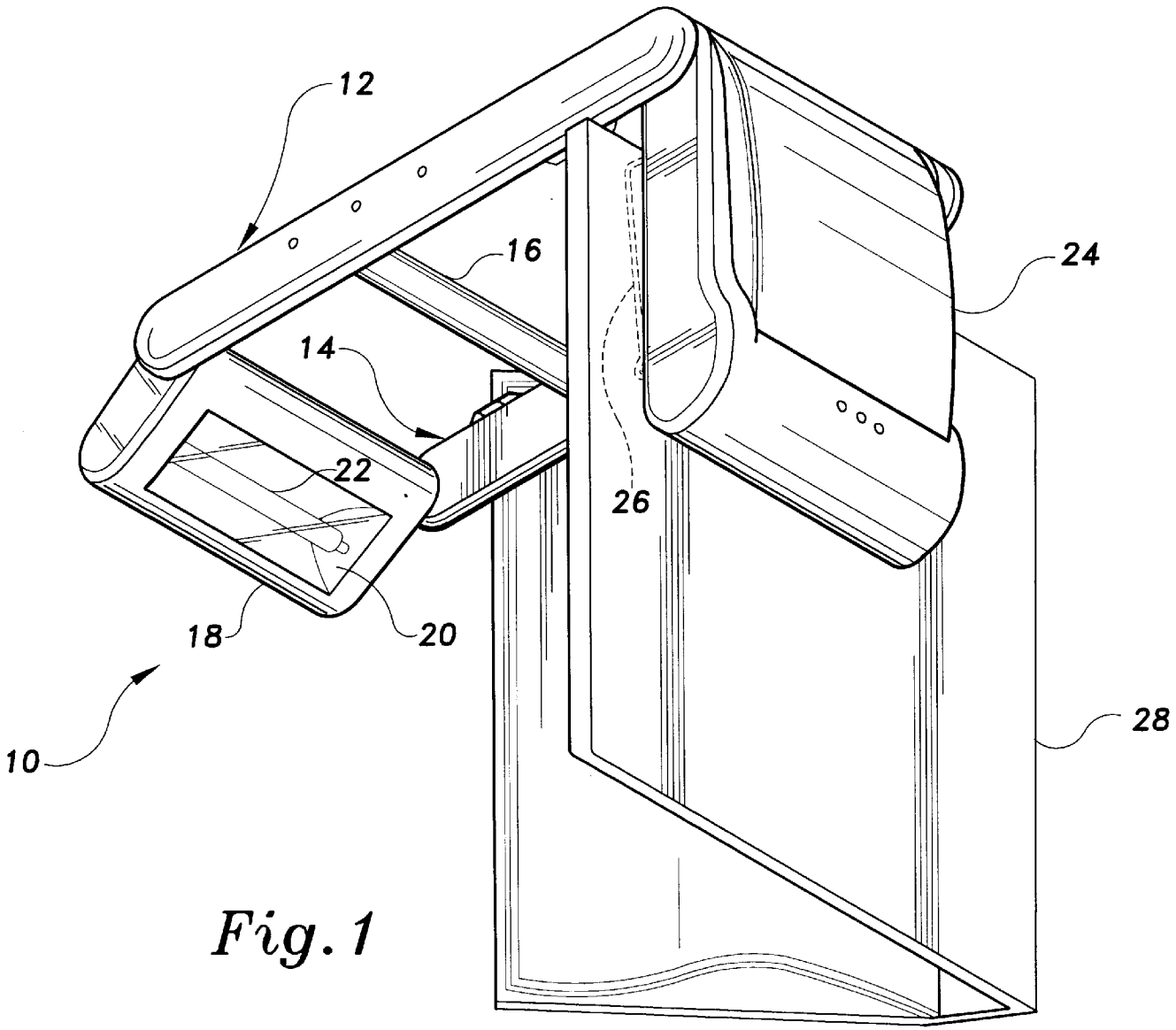
FIG. 1 is an environmental perspective view of a book light according to the present invention.

The present invention relates to a foldable book light 10 for providing excellent illumination. The book light 10 of the present invention is shown in FIG. 1. The book light 10 includes a left arm assembly 12 and a right arm assembly 14 having a support arm 16 running between them and ensuring the stability which renders the light to be such a significant improvement over prior inventions, as noted above. The support member 16, which has an elliptically-shaped cross section, eliminates the twist and torque which would otherwise be associated with a light of dual-arm assembly. A head assembly 18 is pivotally attached to one end of both of the arm assemblies 12 and 14.

The head assembly 18 includes a light assembly or ballast 20 and can receive a Cold Cathode Fluorescent Lamp (CCFL) 22. The CCFL 22 is a high-voltage, high-frequency technology that reduces component size, increases light output, increases usable life (about 10,000 hours), and eliminates the flicker associated with older technology fluorescent lighting. The axis of the CCFL 22 is perpendicular to the arm assemblies 12 and 14, which allows for the light to be more evenly spread to both pages of an open book. The lamp is driven by solid state technology which includes an inverter (to convert from the DC power source provided by four "AA" batteries housed in the rectangular body 24 to the AC technology of the CCFL) mounted to a printed circuit board located in the head assembly 18.

As mentioned above, the rectangular body 24 provides power to the CCFL 22. The rectangular body 24 is pivotally attached to the left and right arm assemblies 12 and 14 at ends opposite the head assembly 18. The rectangular body 24 includes a clip 26 for mounting the book light 10 to a book 28.

Figure 2:
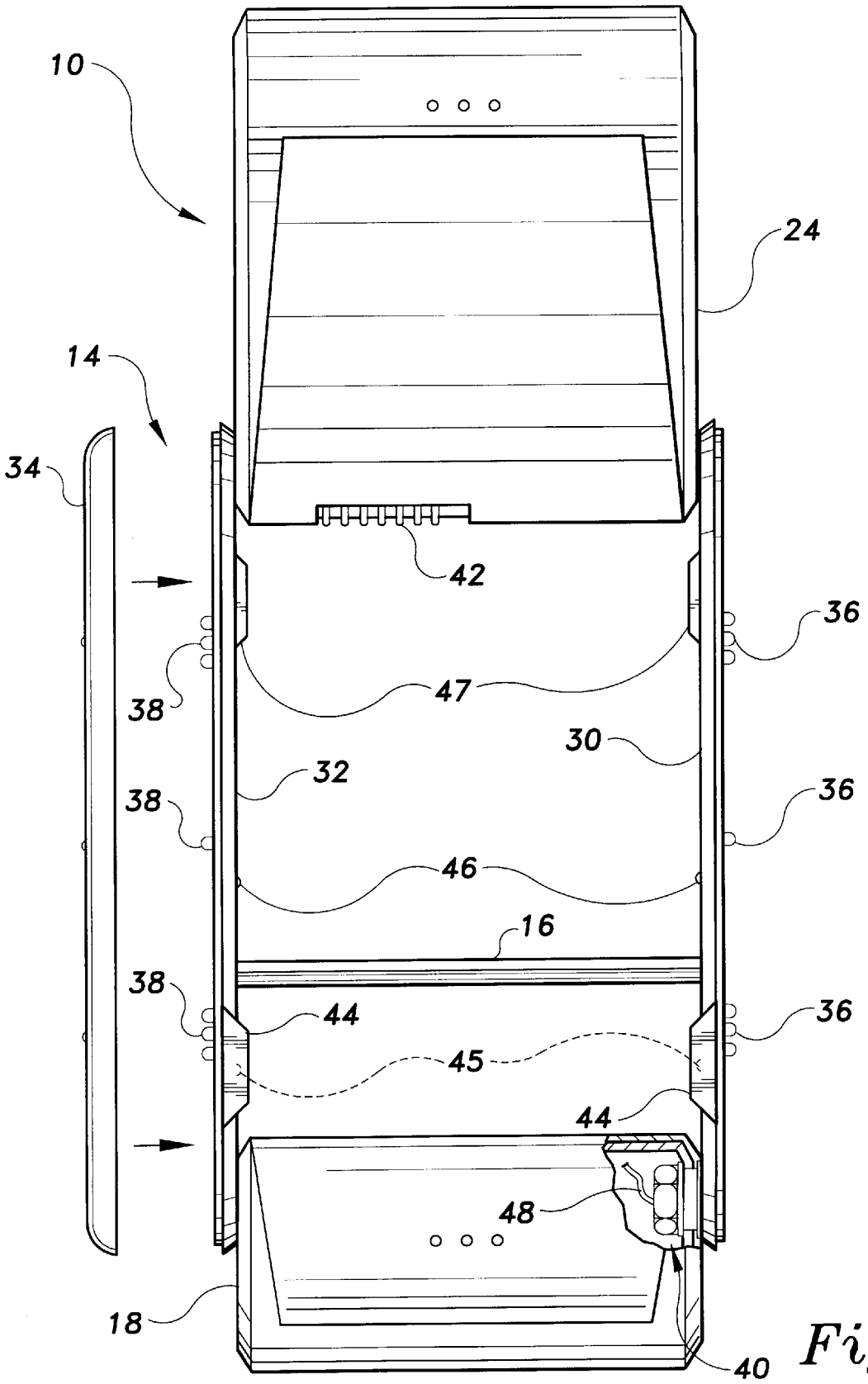
FIG. 2 is a top, cut-away, exploded view of the book light in a fully opened position.
Figure 3:
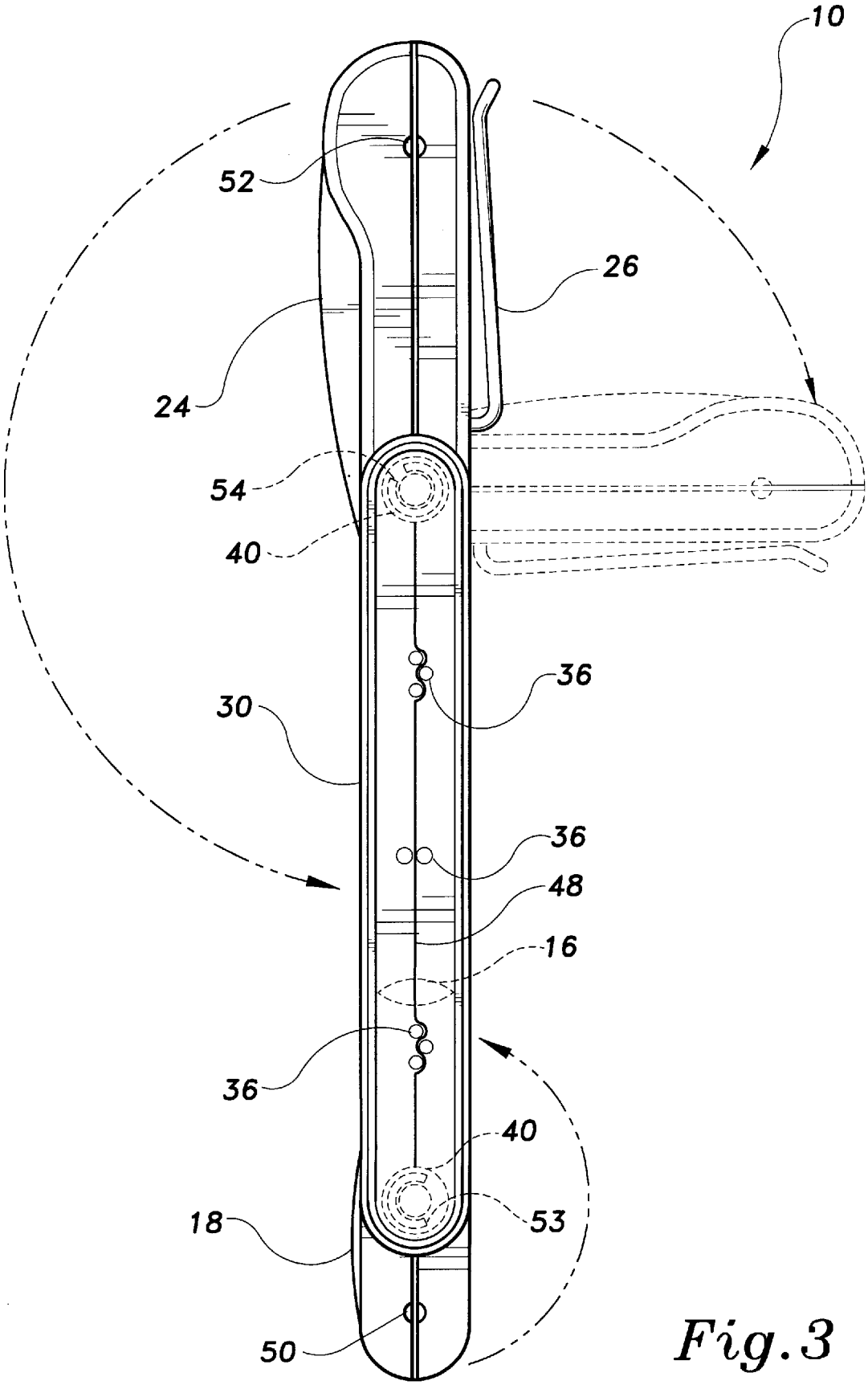
FIG. 3 is a left side view with the left arm cover removed, the right view being a mirror image, of the book light in a fully opened position.

Details of the arm assemblies 12 and 14 and of the pivotal attachment of the head 18 and body 24 are seen in FIGS. 2 and 3. The left and right arm assemblies 12 and 14 include left and right arms 30 and 32 and. left and right wire guides 36 and 38 covered by a left arm cover (not shown) and an identical right arm cover 34. Additionally, as seen in FIG. 3, the arm assemblies 12 and 14 each include a wire or conductive metal strip 48 (the unseen right wire is identical to the left wire 48) which carries current from the body 24 to the head 18.

The head assembly 18 pivots 180° about the arm assemblies 12 and 14 to ensure that light is directed to where it is desired, and to allow for folding of the head 18 into the space between the arm assemblies 12 and 14. The head 18 is secured in the storage position by inserting detentes or protrusions 44, 44 on each arm assembly 12 and 14 into a left head indent 50 (shown in FIG. 3) and a right head indent (not shown). Stops 45, 45 prevent the head assembly 18 from being rotated past the securing point. The stops 45, 45 also ensure that a user cannot pivot the head assembly 18 the wrong way when opening the head assembly 18 from the arm assemblies 12 and 14, thus, guaranteeing the integrity of the pivots 40.

Figure 6:
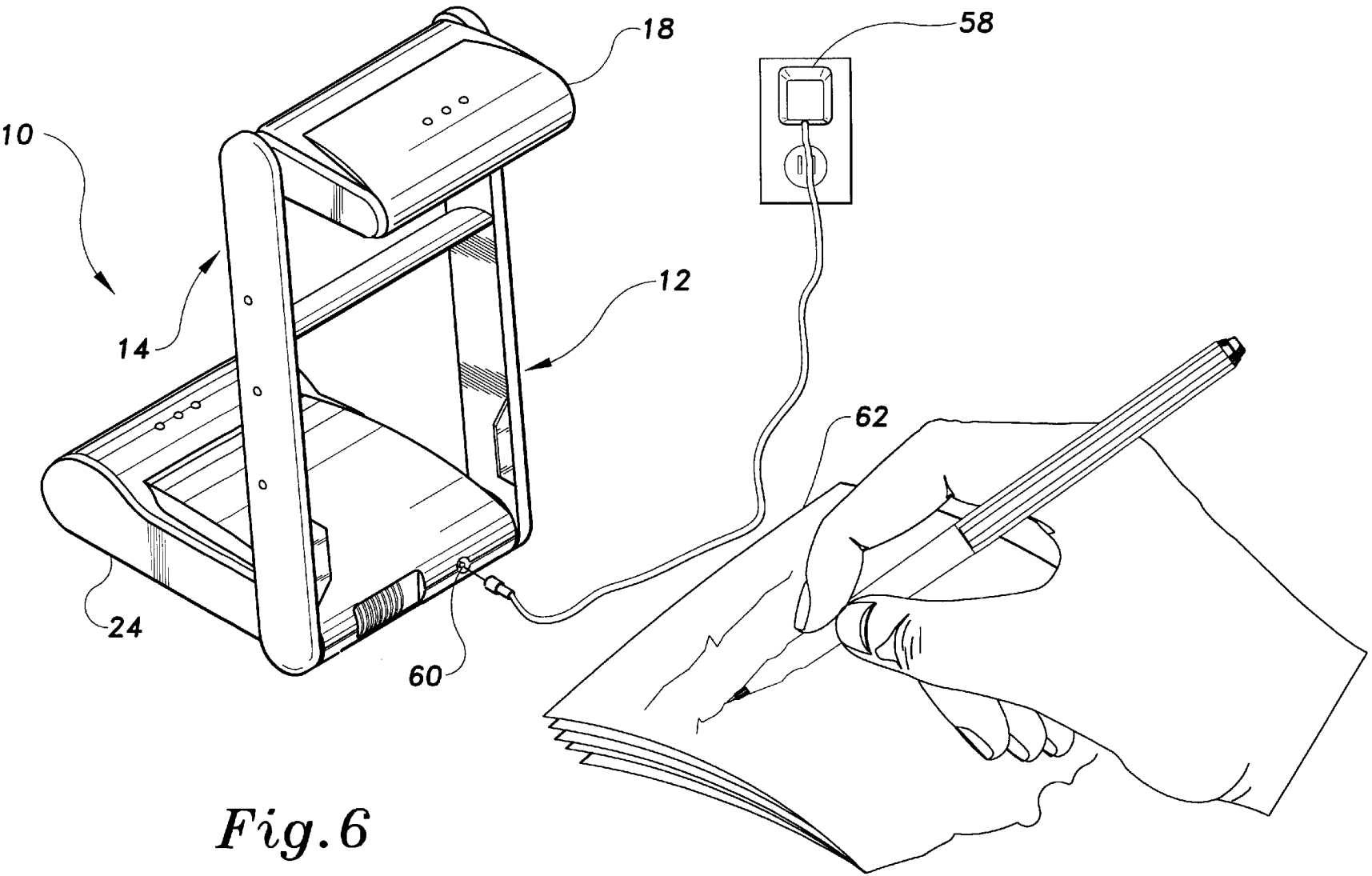
FIG. 6 is an environmental perspective view of the light as a free-standing lamp.

The rectangular body 24, which includes an on/off switch 42, pivots 270° about the arm assemblies 12 and 14 to allow for the folding of the rectangular body 24 into the space between the arm assemblies 12 and 14. The body 24 is secured in the storage position by inserting detentes or protrusions 46, 46 on each arm assembly 12 and 14 into a left body indent 52 (shown in FIG. 3) and a right body indent (not shown). Stops 47, 47 prevent the rectangular body 24 from being rotated past the securing point. The stops 47, 47 also ensure that a user cannot pivot the rectangular body 24 the wrong way when opening the rectangular body assembly 24 from the arm assemblies 12 and 14; thus, guaranteeing the integrity of the pivots 40. The maneuverability of the rectangular body 24 allows the book light 10 to be clipped to a book with the rectangular body 24 below the arm assemblies 12 and 14, as shown in FIG. 1, clipped to the bottom of a shelf with the rectangular body 24 above the arm assemblies 12 and 14, or used as a desk lamp, as shown in FIG. 6 and discussed below.

Figure 4:
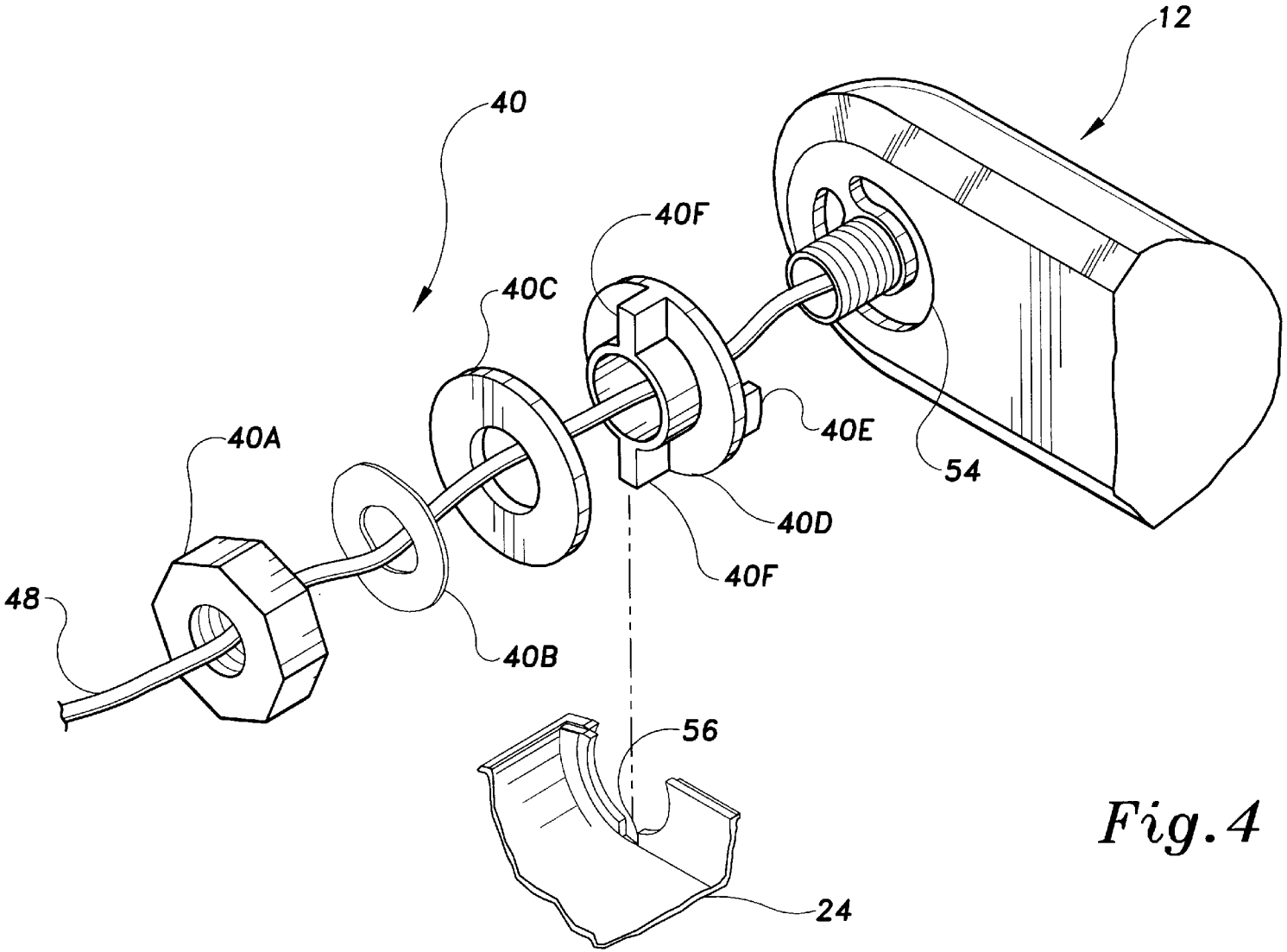
FIG. 4 is an exploded view of the pivot.

The pivot 40, shown in the cut-away portion of FIG. 2 and in the exploded view of FIG. 4, is exemplary of the pivots for both the left and right sides of the head assembly 18 and the rectangular body 24, and includes means (described below) to ensure that the objects remain in their desired relationships. The pivot 40, as seen in FIG. 4, includes a nut 40A, a wave washer 40B, and a nylon washer 40C, which secure a spacer 40D to the arm assembly 12 or 14.

The spacer 40D includes a protrusion 40E which rides in a first channel 54 in the arm assembly 12 or 14. The first channel 54, which is connected to the rectangular body 24, extends circularly for approximately 270°, while the second channel 53 (seen in FIG. 3) connected to the head assembly 18 is approximately 180°. The spacer 40D also includes two protrusions 40F, 40F which fit into slot 56 in the head assembly 18 and the rectangular body 24 (not shown). This construction ensures that the spacer 40D moves with the head assembly 18 or the rectangular body 24. Thus, the nut 40A remains tight and can hold the spacer 40D at any angle to which the head assembly 18 or rectangular body 24 is rotated.

Figure 5A:
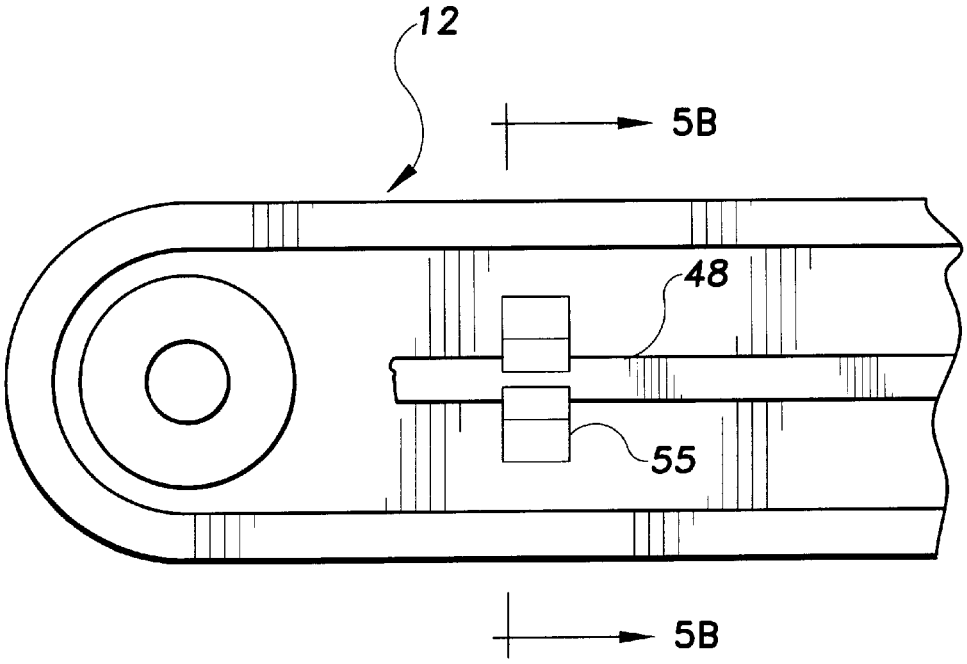
FIGS. 5A is view of an alternative embodiment of a wire guide, shown holding a conductive strip.
Figure 5B:
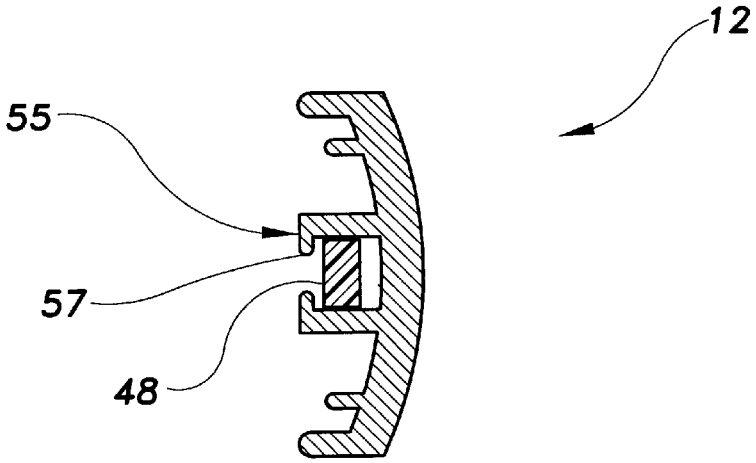
FIG. 5B is cross-sectional view of the alternative wire guide taken across the line 5B—5B in FIG. 5A.

FIGS. 5A and 5B show an alternative embodiment of a wire guide 55. A wire guide 55 is part of the arm assembly 12, as best seen in FIG. 5B. The arm assembly 12 is rounded to strengthen the wire guide 55, i.e. the wire guide 55 and the arm 12 have more contact area. The wire or conductive strip 48 is snapped into the wire guide 55 and rests under tabs 57.

FIG. 6 shows the light 10 used as a desk lamp. The great range of motion of the rectangular body 24 allows for it to act as the base of a desk lamp. When batteries are in the rectangular body 24, their weight allows for the arm assemblies to be positioned at any angle to provide light to any writing surface 62 or anywhere that it is needed. As an alternative to batteries, the light 10 can be powered by a 5 V DC/310 mA adapter 58 which plugs into plug receptacle 60.

Figure 7:
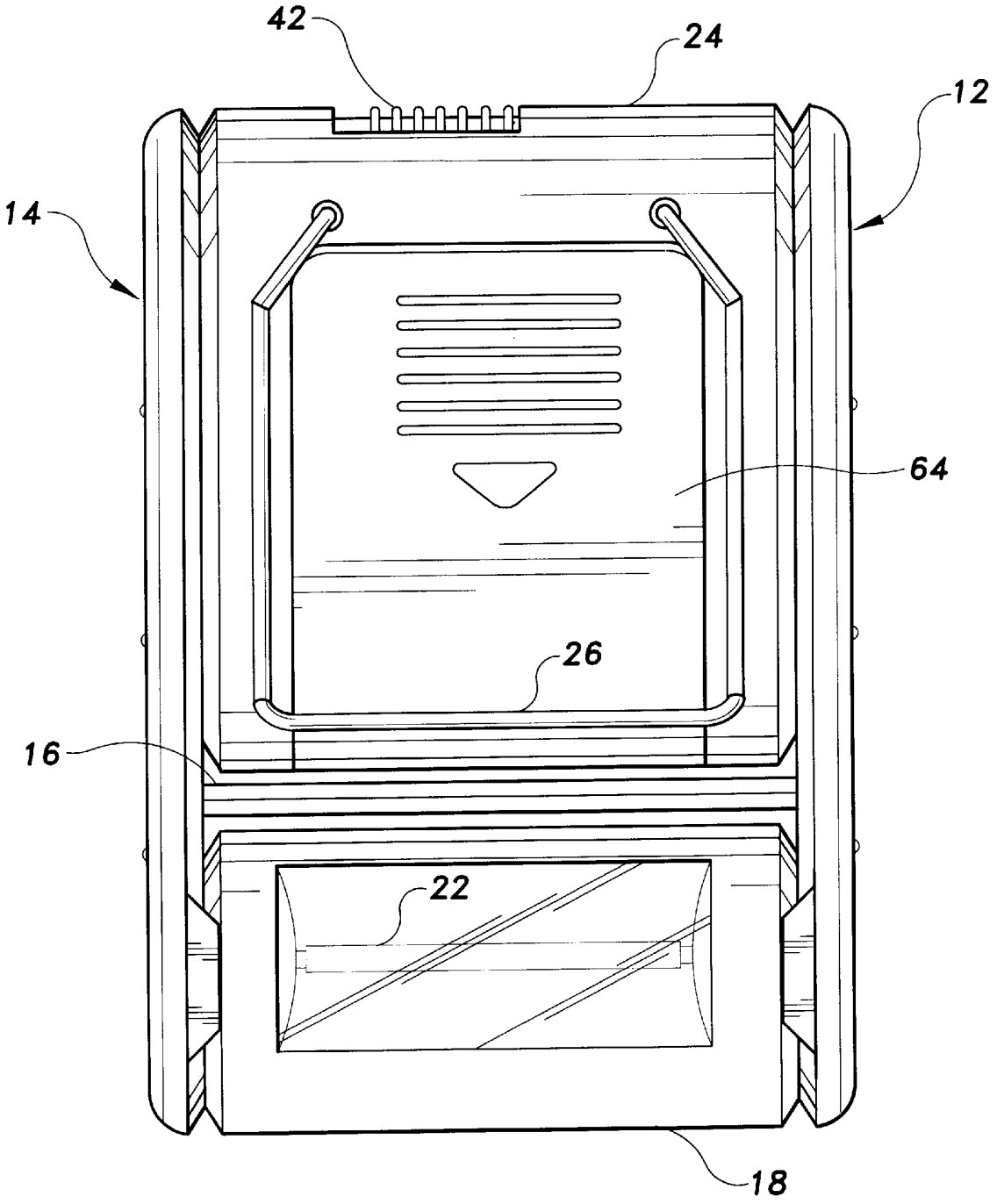
FIG. 7 is a top view of the book light in a fully closed position.

FIG. 7, in which the battery compartment 64 on the rectangular body 24 is seen, shows the book light 10 in a folded position.

Figure 8A:
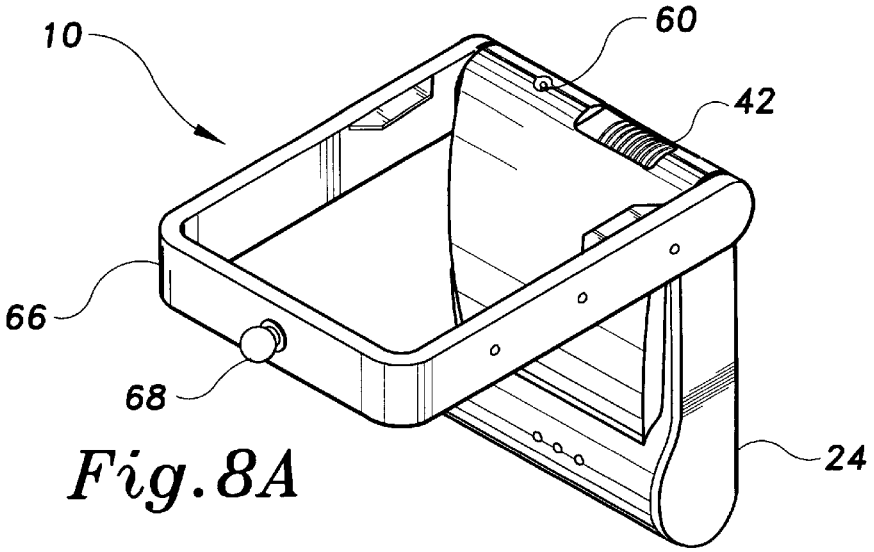
FIG. 8A is a perspective view of a light which uses a "U" bracket, shown without the head so the ball joint can be seen.
Figure 8B:
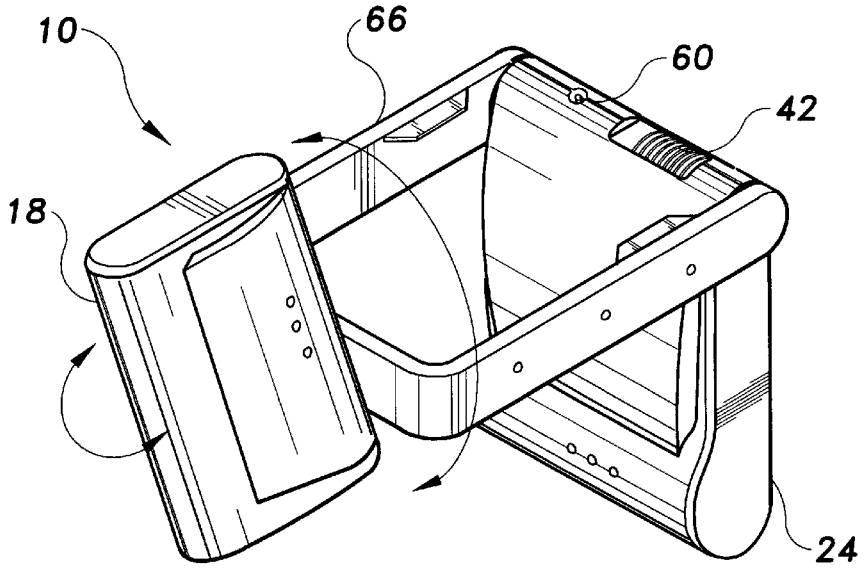
FIG. 8B is a perspective view of a light which uses a "U" bracket, shown with the head.
Figure 8C:
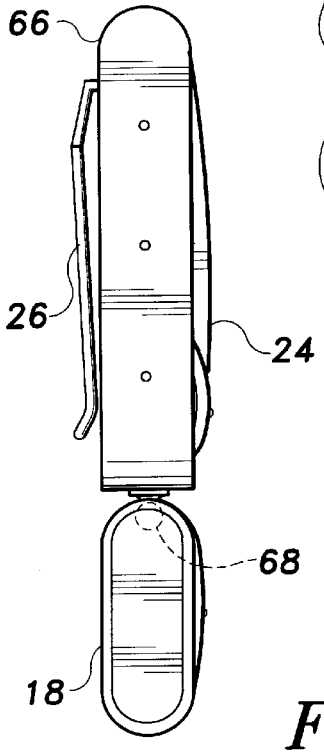
FIG. 8C is a side view of a light which uses a "U" bracket, shown in a folded position.

FIGS. 8A and 8B show a book light 10 utilizing a "U" bracket 66 as the connection between the rectangular body 24 and the head 18. The "U" bracket 66 is essentially a structure having a left and right arm joined at one end, the closed end, by a third or perpendicular arm. The open part of the bracket is pivotally attached to the rectangular body 24 and the closed part is attached to the head 18 by a ball joint 68. This configuration allows for a great degree of movement of the head 18, enabling the user to light each page by turning the head 18 directly towards that page. FIG. 8C shows the book light 10 of this embodiment in a folded position, in which the rectangular body 24 folds into the area defined by the three arms of the "U" bracket 66.

Figure 9A:
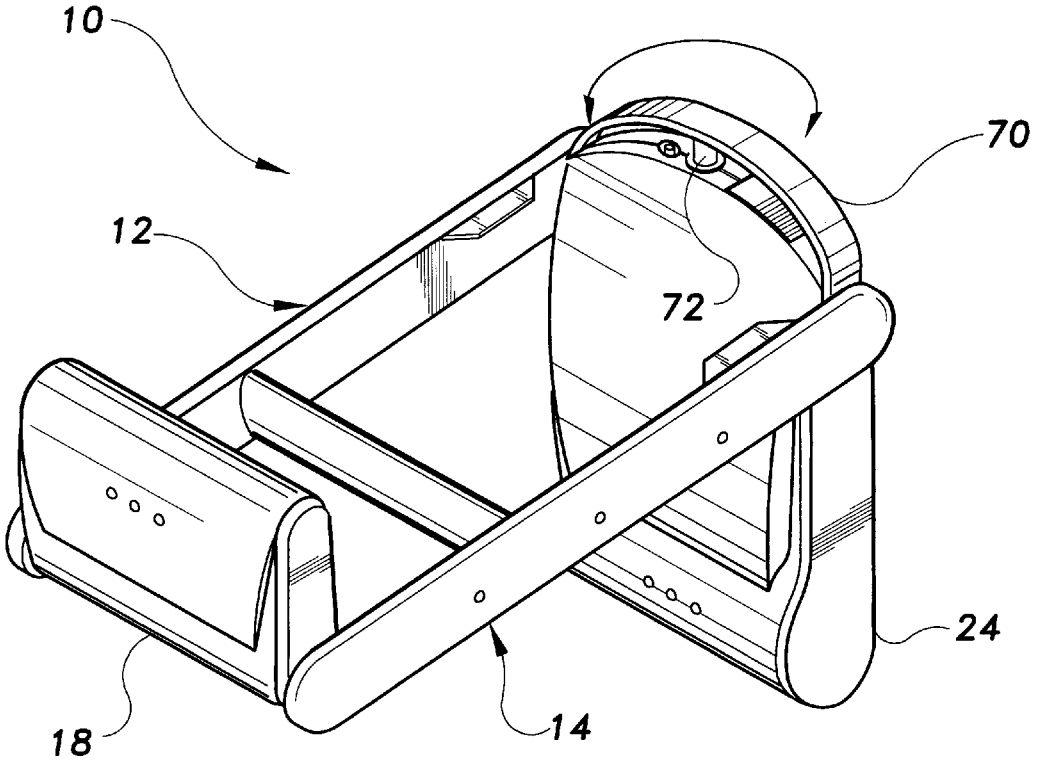
FIG. 9A is a perspective view of a light having two arms mounted on a swivel arm.
Figure 9B:
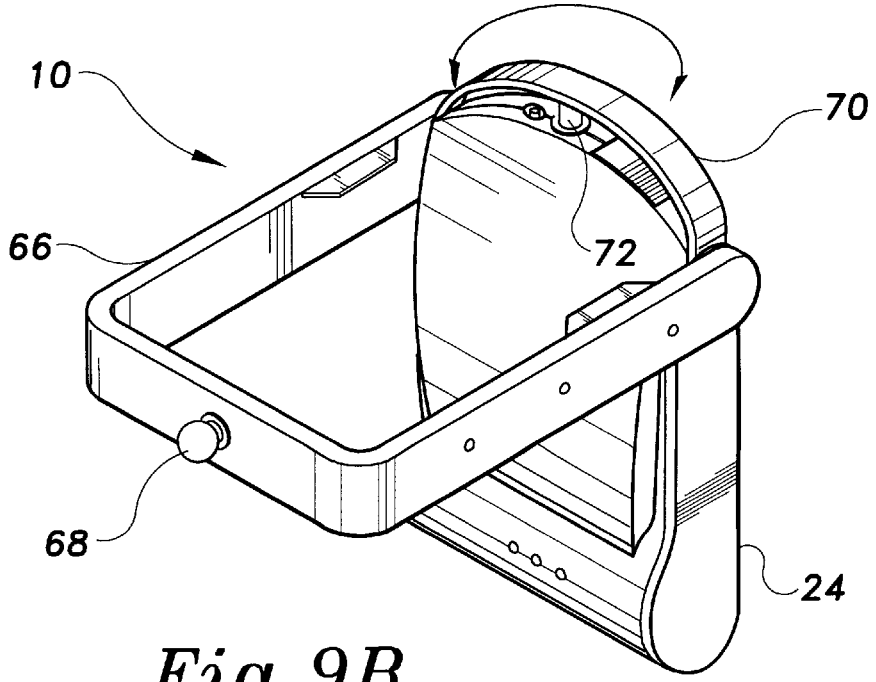
FIG. 9B is a perspective view of a light having a "U" bracket mounted on a swivel arm.

FIGS. 9A and 9B show book lights 10 in which the rectangular body 24 includes a pivot arm portion 70 pivotally attached to the remaining portion of the rectangular body 24 by a pivot 72. The arm assemblies 12 and 14 (see FIG. 9A) and the "U" bracket 66 (see FIG. 9B) are pivotally attached to the pivot arm portion 70. This configuration increases the mobility of the head 18 in that it can be pivoted in a plane perpendicular to that of the rectangular body 24, thereby increasing the functionality of the light 10. In these embodiments of the light 10, as well as all others, there is an electrical connection between the rectangular body 24 and the head 18. This connection may be through wires or electrically-conductive components, such as the ball joint 68, the pivot arm portion 70, or the pivot 72 or any combination thereof.

It is to be understood that the present invention is not limited to the embodiment described above, but encompasses any and all embodiments within the scope of the following claims.

I claim:

1. A book light comprising:

a left arm having a proximate and a distal end and an inner and an outer surface;

a right arm parallel to said left arm having a proximate and a distal end and an inner and an outer surface;

a head having a left and a right surface, and a light assembly; and a rectangular body having a left and a right surface, said rectangular body being pivotally attached to said distal end of said left arm at said left surface of said rectangular body and being pivotally attached to said distal end of said right arm at said right surface of said body;

a first protrusion on the inner surface of each said left arm and said right arm, said first protrusion of said left arm and said first protrusion of said right arm mating with openings in the left and the right surface of said rectangular body, respectively, for fastening said rectangular body in a storage position;

whereby said head can be pivoted to direct light where desired or said head and said rectangular body can be pivoted so that the book light functions as a free-standing desk lamp.

2. The book light as defined in claim 1 wherein said head is pivotally attached to said proximate end of said left arm at said left surface of said head and being pivotally attached to said proximate end of said right arm at said right surface of said head.

3. The book light as defined in claim 2 further including a support arm which extends from said inner surface of said left arm to said inner surface of said right arm.

4. The book light as defined in claim 3 wherein said support arm has an elliptical cross section.

5. The book light as defined in claim 2 wherein said inner surface of said left arm and said inner surface of said right arm each have a second protrusion, said second protrusion of said left arm and said second protrusion of said right arm mating with openings in the left and the right surface of said head, respectively, for fastening said head in a storage position.

6. The book light as defined in claim 1 further comprising a third arm which is perpendicular to said left arm and said right arm and connecting said proximate en d of said left arm to said proximate end of said right arm to form a "U" bracket, said head being pivotally attached to said third arm of said "U" bracket.

7. The book light of claim 1 wherein said rectangular body includes a pivot arm portion connected to a remaining portion of said rectangular body by a pivot, said pivot arm portion of said rectangular body being pivotally attached to said distal end of said left arm at said left surface of said rectangular body and being pivotally attached to said distal end of said right arm at said right surface of said body, whereby said pivot arm portion of said rectangular body, said left arm, said right arm, and said head can be pivoted in a plane perpendicular to the plane of said remaining portion of said rectangular body.

8. The book light as defined in claim 1 wherein said rectangular body includes a clip for attachment to a book or other object at which light is required.

9. The book light as defined in claim 1 wherein said light assembly includes a Cold Cathode Fluorescent Lamp.

10. The bock light as defined in claim 1 further including left wire guides on said left arm, and right wire guides on said right arm.

11. The book light as defined in claim 1 further including a left arm cover which extends from said proximate end to said distal end of said left arm and fits over said outer surface of said left arm, and a right arm cover which extends from said proximate end to said distal end of said right arm and fits over said outer surface of said right arm.

12. The book light as def ined in claim 1 wherein said rectangular body includes an on/off switch and a battery compartment.

13. A book light comprising:

a left arm having a proximate and a distal end, an inner and an outer surface, left wire guides on said outer surface, and a left arm cover which extends from said proximate end to said distal end of said left arm and fits over said left wire guides;

a right arm parallel to said left arm having a proximate and a distal end, an inner and an outer surface, right wire guides on said outer surface of said right arm, and a right arm cover which extends from said proximate end to said distal end of said right arm and fits over said right wire guides;

a support arm which extends from said inner surface of said left arm to said inner surface of said right arm;

a head having a left and a right surface, a light assembly, said head being pivotally attached to said proximate end of said left arm at said left surface of said head and being pivotally attached to said proximate end of said right arm at said right surface of said head; and a rectangular body having a left, a right, and an inner surface, a clip on said inner surface, an on/off switch, and a battery compartment, said rectangular body being pivotally attached to said distal end of said left arm at said left surface of said rectangular body and being pivotally attached to said distal end of said right arm at said right surface of said body;

a first stop near the distal end of each said left arm and said right arm for preventing the improper rotation of said rectangular body;

whereby said head can be pivoted to direct light where desired or said head and said rectangular body can be pivoted so that the book light functions as a free-standing desk lamp.

14. The book light as defined in claim 11 including a pivot at each of said proximate and said distal end of said left arm and said right arm, each said pivot includes a protrusion and each of said left arm and said right arm include means defining a channel at their said proximate and said distal end for receiving said protrusion, whereby said protrusion rotates within said channel.

15. The book light as defined in claim 14 wherein each of said left arm and said right arm includes a second stop near said proximate end for preventing the improper rotation of said head.

16. The book light as defined in claim 13 wherein said rectangular body includes a plug for receiving an adapter for an alternative source of power.

* * * * *